US011433363B2

(12) United States Patent
Gros et al.

(10) Patent No.: US 11,433,363 B2
(45) Date of Patent: Sep. 6, 2022

(54) MIXER SYSTEM FOR PRODUCING A COSMETIC PRODUCT AND DISPENSING BOTTLE

(71) Applicant: B2B COSMETICS, La Seyne sur Mer (FR)

(72) Inventors: Julien Gros, Toulon (FR); Grégoire Tutenuit, Toulon (FR)

(73) Assignee: B2B COSMETICS, La Seyne sur Mer (FR)

( * ) Notice: Subject to any disclaimer, the term of this patent is extended or adjusted under 35 U.S.C. 154(b) by 787 days.

(21) Appl. No.: 16/329,789

(22) PCT Filed: Sep. 1, 2017

(86) PCT No.: PCT/FR2017/052326
§ 371 (c)(1),
(2) Date: Jul. 1, 2019

(87) PCT Pub. No.: WO2018/042137
PCT Pub. Date: Mar. 8, 2018

(65) Prior Publication Data

US 2019/0314774 A1 Oct. 17, 2019

(30) Foreign Application Priority Data

Sep. 2, 2016 (FR) ..... 16 58 178

(51) Int. Cl.
*B01F 23/00* (2022.01)
*B01F 23/40* (2022.01)
(Continued)

(52) U.S. Cl.
CPC ..... *B01F 23/49* (2022.01); *A45D 34/00* (2013.01); *B01F 23/41* (2022.01); *B01F 23/43* (2022.01);
(Continued)

(58) Field of Classification Search
CPC .. B01F 2215/0031; B01F 3/088; A45D 34/00; A45D 2200/058
See application file for complete search history.

(56) References Cited

U.S. PATENT DOCUMENTS

2003/0062379 A1* 4/2003 Bartholomew ..... B01F 13/1066 222/1
2006/0118581 A1* 6/2006 Clark ..... B01F 13/1066 222/333
(Continued)

FOREIGN PATENT DOCUMENTS

EP 1813334 A2 8/2007
KR 101610834 B1 4/2016
WO 2008006553 A2 1/2008

OTHER PUBLICATIONS

International Search Report for corresponding application PCT/FR2017/052326 filed Sep. 1, 2017; dated Feb. 15, 2018.

*Primary Examiner* — Anshu Bhatia
(74) *Attorney, Agent, or Firm* — Cantor Colburn LLP

(57) ABSTRACT

The invention relates to a mixer system for producing a cosmetic product. The invention also relates to a bottle for dispensing a cosmetic product. The mixer system is used to produce a cosmetic product from capsules (7, 8, 9) containing the raw materials needed in the composition of such a cosmetic product, namely the cosmetic texturiser, the cosmetic active ingredient and, optionally, a cosmetic fragrance. The invention is intended to be used in the cosmetics industry.

16 Claims, 5 Drawing Sheets

(51) Int. Cl.

| | |
|---|---|
| ***A45D 34/00*** | (2006.01) |
| ***B01F 23/41*** | (2022.01) |
| ***B01F 23/43*** | (2022.01) |
| ***B01F 27/88*** | (2022.01) |
| ***B01F 27/92*** | (2022.01) |
| ***B01F 35/93*** | (2022.01) |
| ***B01F 35/71*** | (2022.01) |
| ***B01F 35/75*** | (2022.01) |
| *B01F 35/90* | (2022.01) |
| *B01F 101/21* | (2022.01) |

(52) U.S. Cl.

CPC ..... *B01F 27/88* (2022.01); *B01F 27/92* (2022.01); *B01F 35/7131* (2022.01); *B01F 35/7176* (2022.01); *B01F 35/754251* (2022.01); *B01F 35/93* (2022.01); *A45D 2200/055* (2013.01); *A45D 2200/058* (2013.01); *B01F 2035/99* (2022.01); *B01F 2101/21* (2022.01)

(56) References Cited

U.S. PATENT DOCUMENTS

| | | | | |
|---|---|---|---|---|
| 2010/0024361 | A1* | 2/2010 | Ebeling ..... | G06Q 10/083 53/443 |
| 2016/0183716 | A1 | 6/2016 | Harrington | |
| 2017/0246602 | A1* | 8/2017 | Dean ..... | B01F 15/00922 |

* cited by examiner 34
37
35
36
15
8
9
14
14
7
3
16

Fig.3
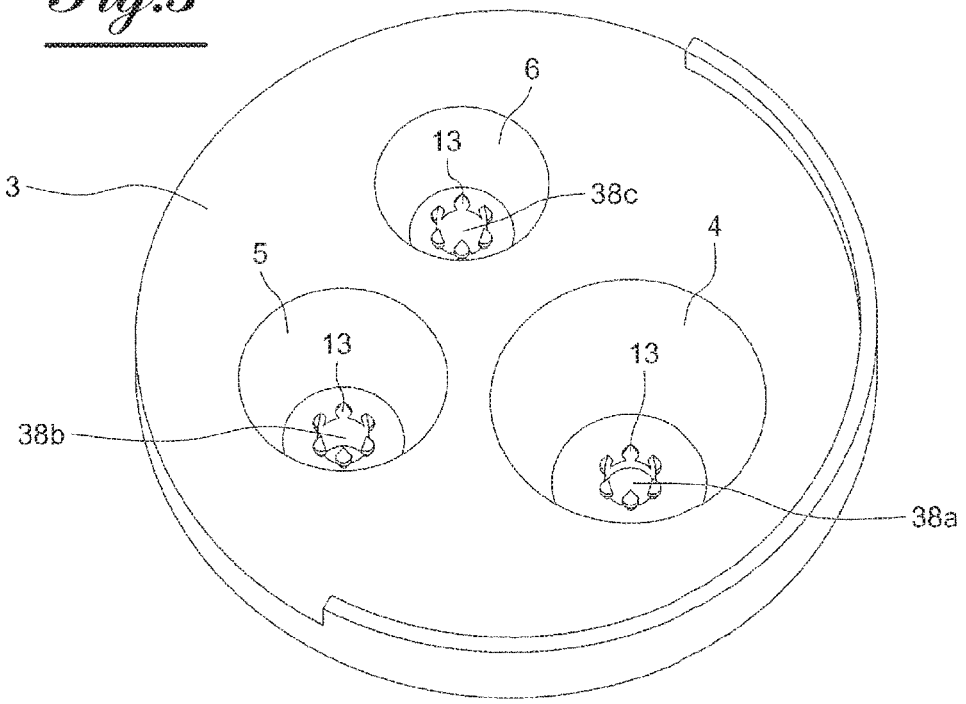
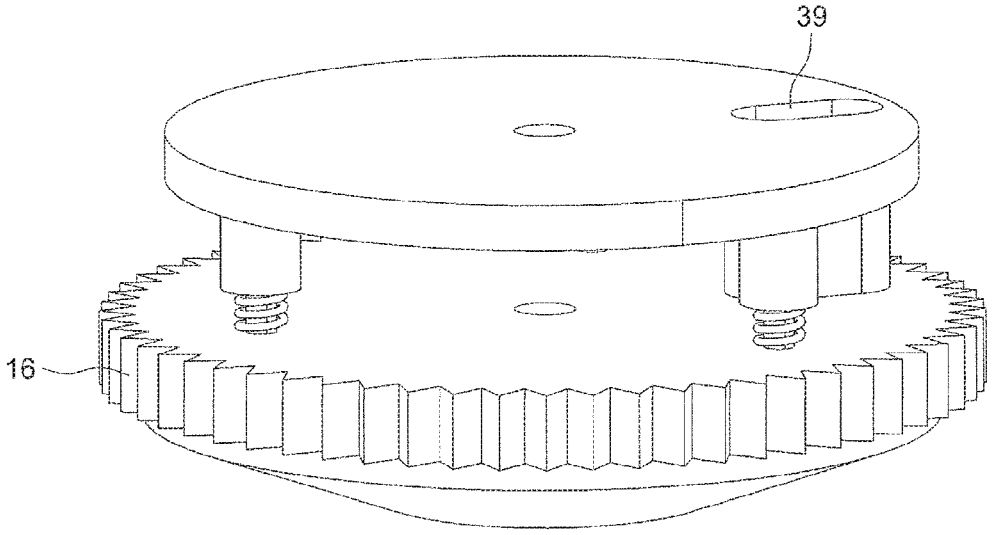
Fig.4

MIXER SYSTEM FOR PRODUCING A COSMETIC PRODUCT AND DISPENSING BOTTLE

TECHNICAL FIELD

The disclosure relates to a mixing system for producing a cosmetic product. The disclosure also relates to a bottle for storing and dispensing a cosmetic product produced with the emulsifying system.

BACKGROUND

In a manner known in itself, cosmetic products, for example hydrating and/or antiwrinkle creams, are in particular made up of a fat forming the oil phase and in particular containing plant oils, butters, emulsifying waxes for cosmetic use, an aqueous phase generally containing pure or floral water, or any agent soluble in water and at least one additive called active ingredient giving the cosmetic product the desired efficacy. As an example, this active ingredient can be an antiaging active ingredient such as hyaluronic acid. Furthermore, the cosmetic product may comprise a natural or synthetic fragrance, which makes the application and use of the cosmetic product more pleasant.

However, the available cosmetic products in emulsion form do not offer the possibility of freely choosing their composition in terms of fat, active ingredients and fragrances, the fat in particular influencing the texture of the cream, its viscosity, its spreading power, and how it feels on application. Furthermore, the consumer cannot always find the desired combination of fat active ingredient fragrance.

BRIEF SUMMARY

The present disclosure aims to offset the above drawbacks of the prior art.

To achieve this aim, the disclosure relates to a mixing system for manufacturing a cosmetic product comprising:

- A liquid reservoir;
- A liquid pump connected to the outlet of the liquid reservoir;
- A receptacle comprising two compartments connected to the liquid pump and suitable for respectively including two capsules containing, for one, a cosmetic texturizing agent, and the other, a cosmetic active ingredient and means for piercing the capsules to allow a forced circulation of liquid from the liquid pump through the two capsules;
- A liquid heating means capable of passing through the cosmetic texturizing agent capsule;
- A mixing device comprising a container positioned to be in fluid communication with the outlet of each of the two compartments of the receptacle and a mixing member housed in the container and able to create, in said container, the cosmetic product from the two mixtures of liquid and cosmetic texturizing agent and of liquid and cosmetic active ingredient coming from two compartments of the receptacle to produce the cosmetic product.

According to another particularity, the mixing member is a helix mounted at the bottom of the container on an axle coaxial thereto, passing through the bottom wall of the container and able to be driven by a motor, in particular electric, mounted in the mixing system.

According to another particularity, the container comprises an opening with a timed valve in its bottom wall to allow the flow of the hot cosmetic product into a storage bottle for the cosmetic product.

According to another particularity, the container is a removable cylindrical tube closed by a bottom wall to allow the storage of the cosmetic product for later use thereof and positioned below two compartments of the receptacle.

According to another particularity, the receptacle includes a third compartment connected to the liquid pump and suitable for including a third capsule containing a cosmetic fragrance intended to be included in the composition of the cosmetic product, the container also being connected at the outlet of said third compartment.

According to another particularity, the piercing means comprise teeth protruding from the bottom wall of each compartment to respectively pierce first walls of the capsules placed in the corresponding compartments, and hollow needles connected to the liquid pump and passing through a manually movable cover of the receptacle and intended to cover the compartments to respectively pierce second walls of the capsules placed in the corresponding compartments.

According to another particularity, the mixing system comprises a controlled rotary selector plate positioned between the respective outlets of the compartments and the container and including a through orifice able to be positioned selectively and successively at the outlet of the cosmetic texturizing agent capsule compartment for the passage of the mixture of liquid and cosmetic texturizing agent in the container and at the outlet of the cosmetic active ingredient capsule compartment for the passage of the mixture of liquid and cosmetic active ingredient in the container and, if applicable, at the outlet of the cosmetic fragrance capsule compartment for the passage of the mixture of liquid and cosmetic fragrance in the container.

According to another particularity, the mixing system comprises a hollow coolant circulation block at least partially surrounding the container, and whereof the liquid inlet and outlet of said coolant block are connected to the liquid reservoir by another pump to provide the cooling of the mixture contained in the container.

According to another particularity, the liquid reservoir comprises two compartments separated by an inner wall, one of the compartments being connected to the liquid pump of the mixing system and the other compartment being connected to the cooling block via the other pump.

According to another particularity, the heating means is an internal electrical resistance heating block positioned between the liquid pump of the mixing system and the compartment suitable for receiving the cosmetic texturizing agent capsule.

According to another particularity, the mixing system comprises two solenoid valves respectively positioned between the liquid pump of the mixing system and the compartment capable of receiving the cosmetic texturizing agent capsule and between the liquid pump of the mixing system and at least the other compartment capable of receiving the cosmetic active ingredient capsule, to control the circulation of liquid in the compartments through the capsules.

According to another particularity, the mixing system comprises a flow meter connected to the liquid pump of the mixing system and in that it comprises a control means successively able to:

- Move the selector plate to bring its orifice into fluid communication with the outlet of the compartment including the cosmetic texturizing agent capsule and open the solenoid valve connected to said compartment to provide the circulation during a given time interval of a first liquid volume through the capsule and calculated from data from the flowmeter;

Move the selector plate to bring its orifice into fluid communication with the outlet of the compartment including the cosmetic active ingredient capsule, open the solenoid valve connected to said compartment to provide the circulation during a given time interval of a second volume of liquid through the capsule and calculated from data from the flowmeter, and close the solenoid valve connected to the compartment comprising the cosmetic texturizing agent capsule;

If applicable, move the selector plate to bring its orifice into fluid communication with the outlet of the compartment including the cosmetic fragrance capsule and keep the solenoid valve connected to said compartment and to the compartment including the cosmetic active ingredient capsule open in order to provide the circulation, during a given time interval, of a third volume of liquid through the cosmetic fragrance capsule and calculated from data from the flowmeter.

According to another particularity, the mixing member comprises a piston forming the bottom wall of the container and a plurality of radial fins secured to the piston and protruding from the upper face of the piston that is able to be rotated with the fins, when the removable container is mounted on the mixing system, by a toothed crown mounted in a support base of the container coaxially to the latter and the axial teeth of which situated on a same side are coupled to the piston, said toothed crown being able to be rotated by an electric motor of the mixing system.

According to another particularity, the mixing member of the mixing device makes it possible to produce an emulsion from two mixtures of liquid coming from the reservoir and melted cosmetic texturizing agent and liquid coming from the reservoir and cosmetic active ingredient coming from the two compartments of the receptacle, if applicable from the third liquid mixture coming from the reservoir and cosmetic fragrance coming from the third compartment of the receptacle to produce the cosmetic product.

The disclosure also relates to a bottle for storing and dispensing a cosmetic product made using a mixing system as previously described, comprising the container removed from the mixing system and filled with the produced cosmetic product and a head closing the opening of the container opposite the piston and including a pump for dispensing the cosmetic product and a trigger able to be actuated manually for dispensing a volume of cosmetic product at the outlet of the head during pressing on the trigger and to create a vacuum in the container causing the piston to move in the container toward the head in order to offset the volume of cosmetic product dispensed.

The disclosure also relates to a use of a mixing system as previously described with two capsules respectively comprising a cosmetic texturizing agent and a cosmetic active ingredient for producing a cosmetic product.

According to another particularity, the mixing system is used with a third capsule containing a cosmetic fragrance.

BRIEF DESCRIPTION OF THE DRAWINGS

The disclosure will be better understood, and other aims, features, details and advantages thereof will appear more clearly, in the following explanatory description done in reference to the appended drawings provided solely as an example illustrating one embodiment of the disclosure and in which:

FIG. 3 shows a top perspective view of the receptacle of FIG. 2;

FIG. 4 shows a perspective top view of the selector plate of FIG. 3;

DETAILED DESCRIPTION

Figure 1:
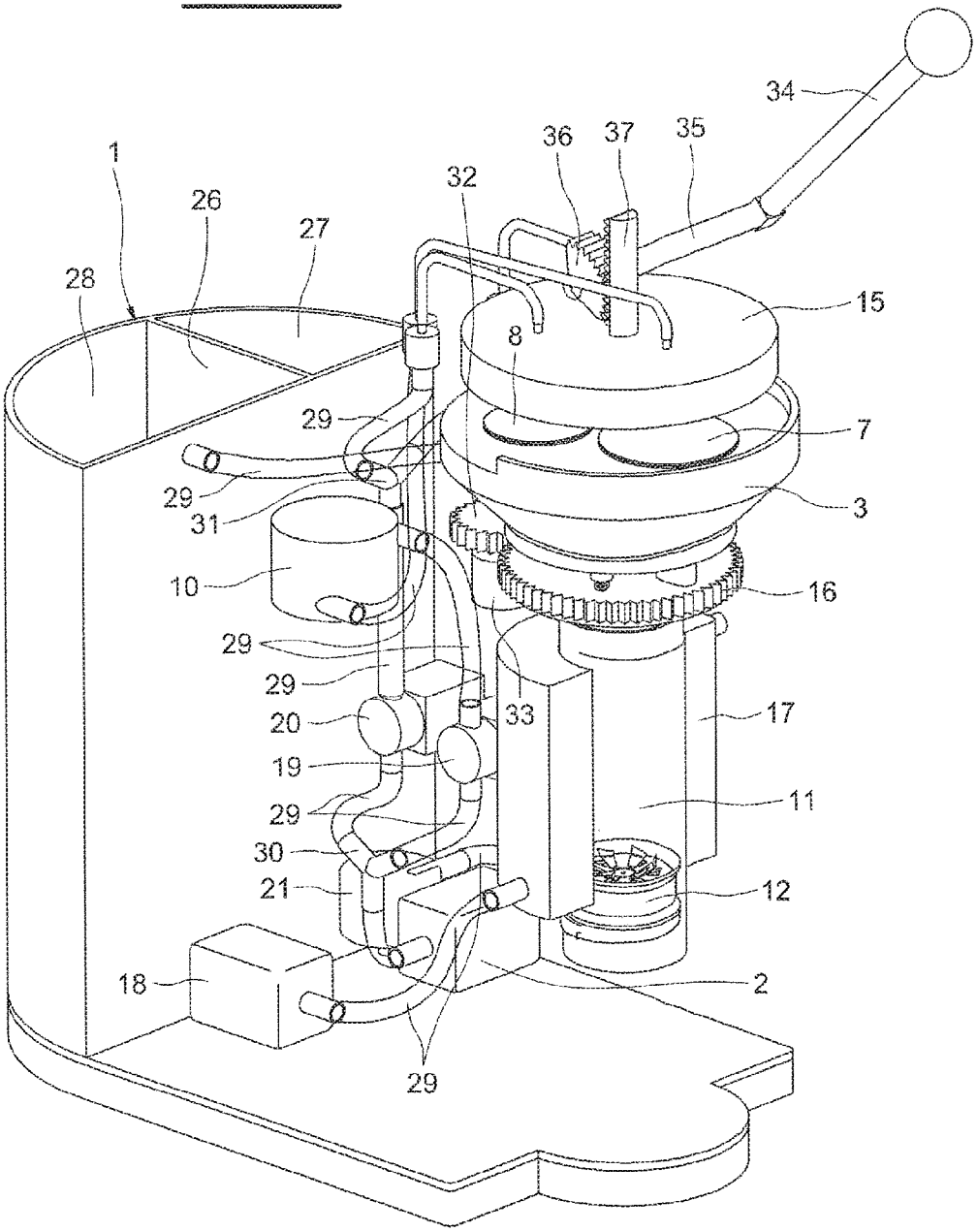
FIG. 1 shows a three-dimensional perspective view of the mixing system according to the disclosure.
Figure 2:
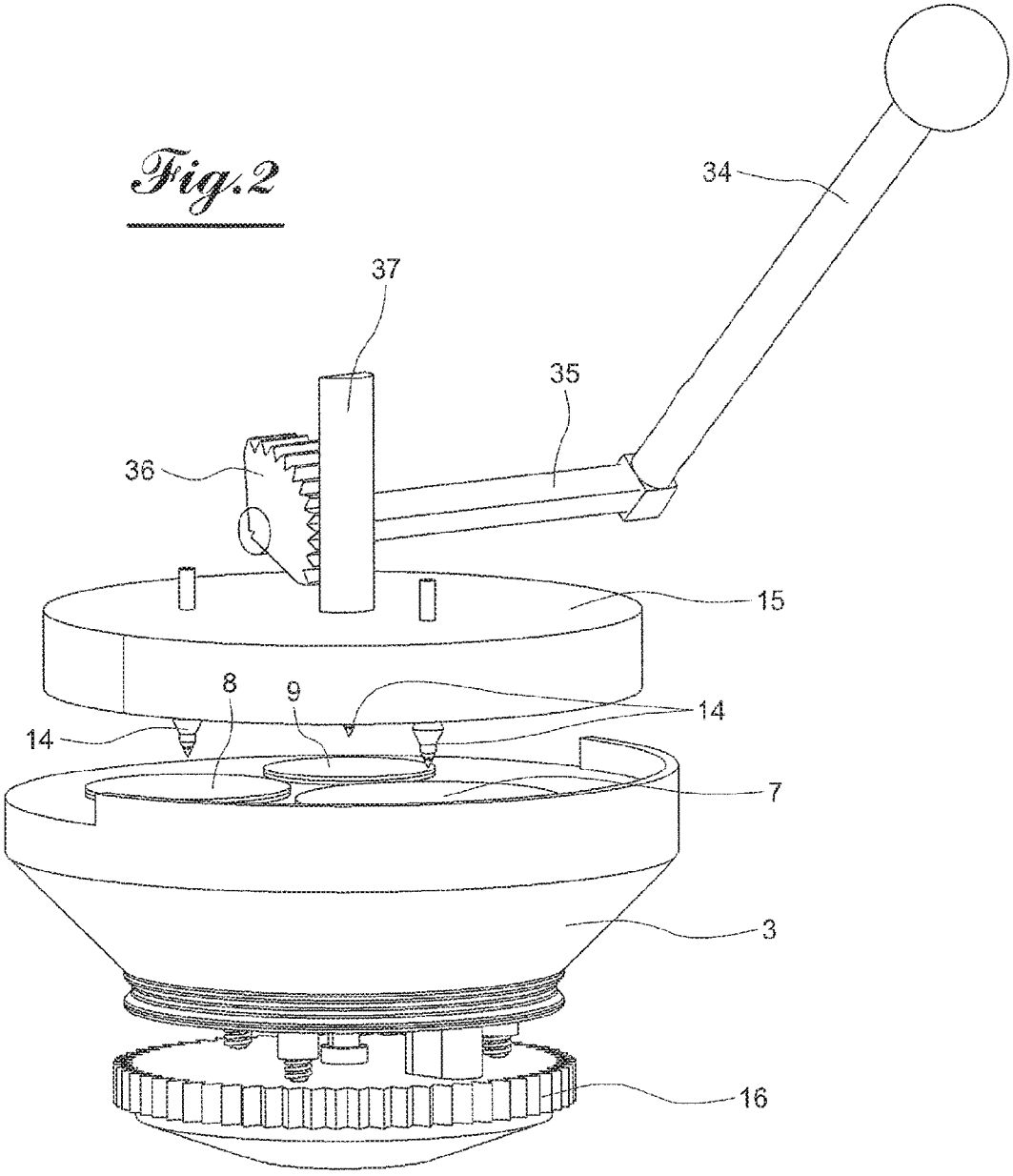
FIG. 2 shows a perspective view of part of the mixing system of FIG. 1 comprising a receptacle, a cover and a selector plate.
Figure 5:
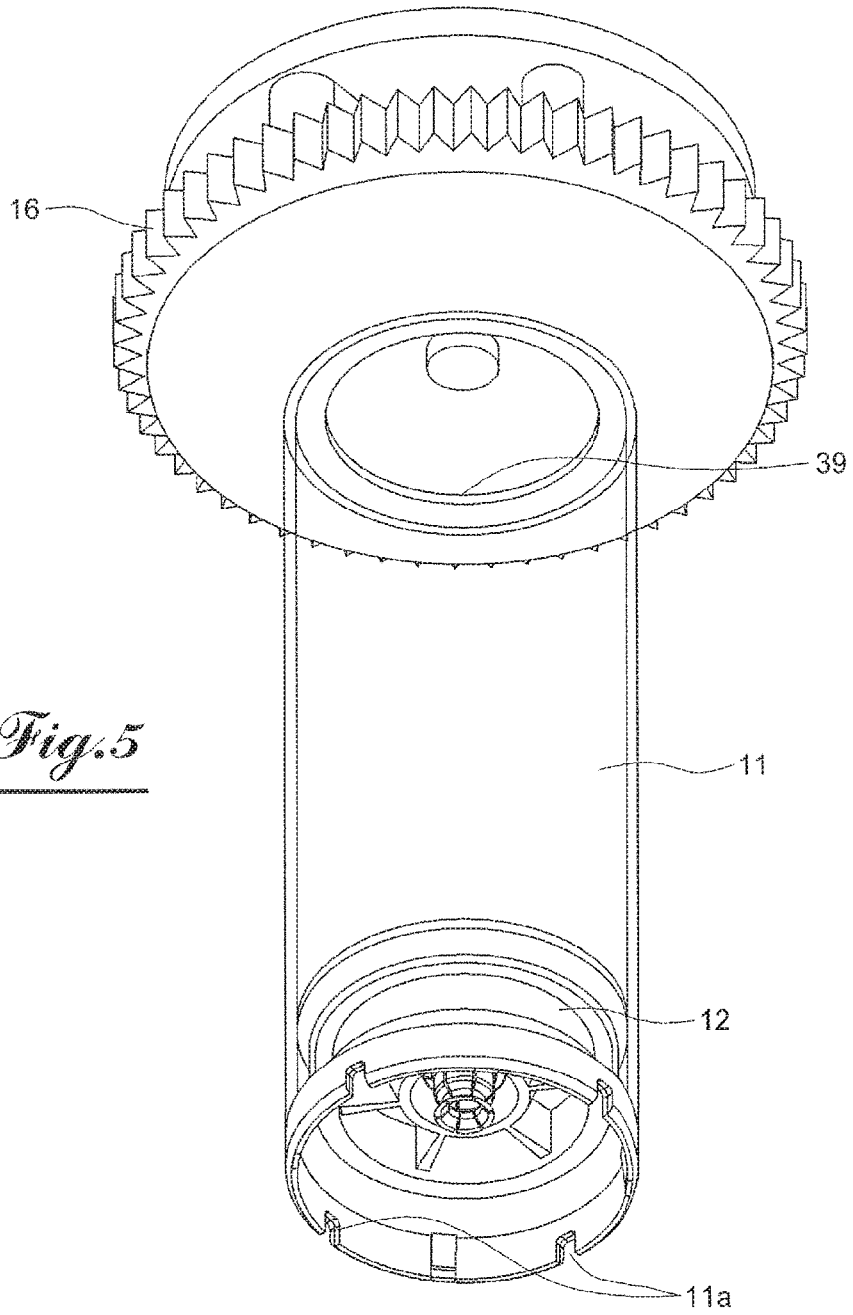
FIG. 5 shows a perspective bottom view of the selector plate of FIG. 2 in fluid communication with a container of the mixing system of FIG. 1.
Figure 6:
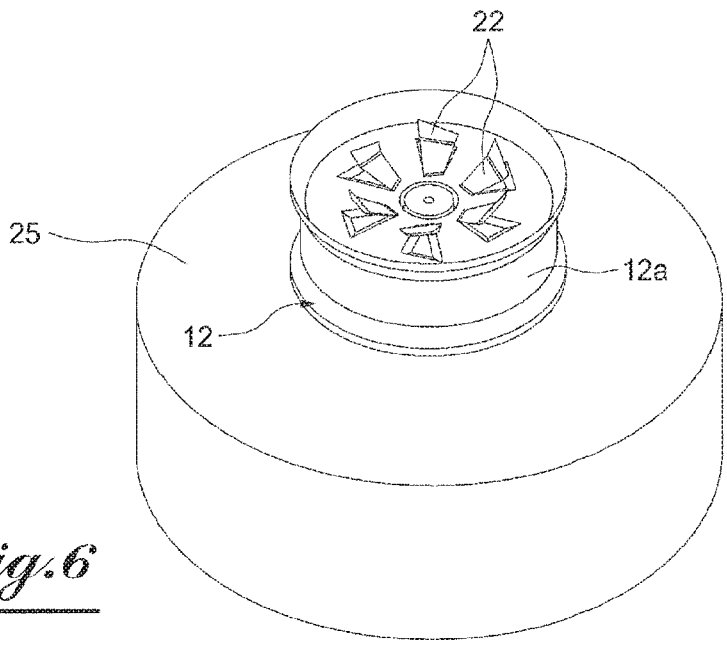
FIG. 6 shows a perspective view of a piston with fins forming a bottom wall of the container of FIG. 5.
Figure 7:
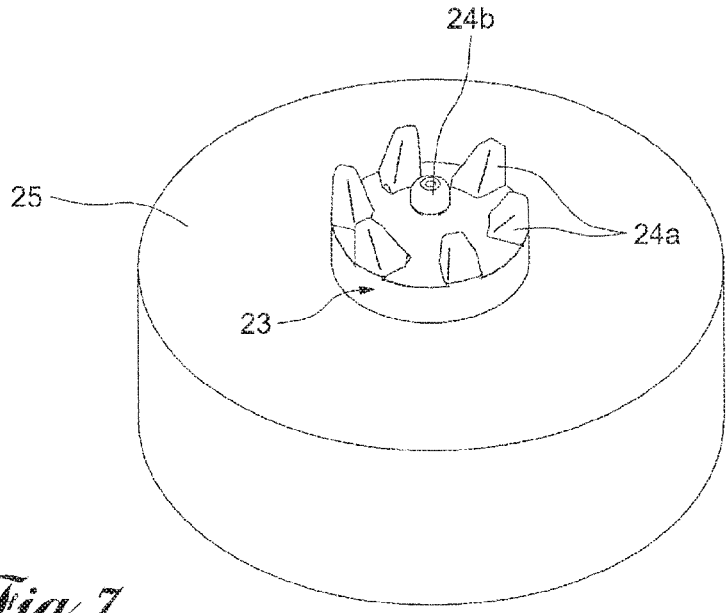
FIG. 7 shows a perspective view of a toothed crown intended to drive the piston of FIG. 6.

In reference to the figures and according to the disclosure, a mixing system for producing a cosmetic product will now be described.

The mixing system comprises a liquid reservoir 1. This liquid reservoir 1 comprises an inner wall 26 separating the reservoir 1 into a first liquid compartment 27 and a second liquid compartment 28, the respective functions of which will be specified below. The liquid compartment 27 comprises the aqueous phase entering the composition of the cosmetic product, and which is preferably demineralized water or floral water (i.e., a hydrolat), but it may also be a more complex aqueous liquid made up of water and additives such as glycerin or a polymer allowing the creation of a three-dimensional network. The liquid compartment 28 in turn comprises pure or demineralized water, or simply tap water. In the remainder of the description, the first and second liquid compartments 27 and 28 will be called first and second water compartments 27 and 28.

The mixing system comprises a liquid pump 2 controlled by a control means of the mixing system and the inlet of which is connected to the outlet of the first water compartment 27 of the reservoir 1. The control means is for example an electronic circuit supplied with electricity via a transformer comprised in the mixing system and connected to the home electrical system. For greater simplicity in the continuation of the description, this liquid pump 2 will be called water pump 2. The water pump 2 is suitable for providing the circulation of water coming from the first water compartment 27 of the reservoir 1 toward a receptacle 3 comprising at least two compartments 4, 5, and preferably three compartments 4, 5, 6 as shown in FIG. 3, the compartments of the receptacle 3 thus being connected to the water pump 2. The receptacle 3 has a substantially frustoconical shape, in which the compartments 4, 5, 6 are formed. Furthermore, the bottom wall of each compartment 4, 5, 6 comprises, in its center, a circular through orifice 38*a*, 38*b*, 38*c* for allowing the flow of liquid in a mixing device of the mixing system, as will be explained later.

The compartments 4, 5, 6 of the receptacle are intended to house capsules 7, 8, 9 containing various compounds for developing the final cosmetic product. The first compartment 4 of the receptacle 3 is suitable for housing a capsule 7 containing a cosmetic texturizing agent. This texturizing agent is preferably a cosmetic fat, optionally doped with an emulsifier with a base of amphiphilic molecules. Alternatively, this texturizing agent is a polymer for cosmetic use, for example a polyoside such as xanthan gum or an acrylic acid polymer of the carbomer type. For greater simplicity in the remainder the description, this cosmetic texturizing agent capsule 7 will be called cosmetic fat capsule 7.

The second compartment 5 of the receptacle 3 is suitable for housing a capsule 8 containing a cosmetic active ingredient, i.e., a compound known for its cosmetic properties, for example antiwrinkle or hydrating properties. Furthermore, this capsule 8 may comprise a preservative product mixed with the cosmetic active ingredient. The third compartment 6 of the receptacle 3 is in turn suitable for housing a capsule 9 containing a cosmetic fragrance, to scent the final cosmetic product.

The receptacle also comprises a circular lid 15 intended to cover the compartments 4, 5, 6 of the receptacle 3. This lid 15 is manually translatable between a closed position completely covering the compartments 4, 5, 6 and an open position via a maneuvering arm 34 secured to a cylindrical axle 35 rotatably mounted via bearings to a housing (not shown) secured to the receptacle 3, and the end of which comprises a toothed sector 36 meshing with a rack-forming rod 37 protruding perpendicularly and coaxially from the face of the circular lid 15 opposite the face of the lid 15 covering the compartments 4, 5, 6 of the receptacle 3.

The mixing system further comprises piercing means of the capsules 7, 8, 9, on the one hand comprising a plurality of teeth 13 protruding from the bottom wall of each compartment 4, 5, 6 of the receptacle 3 and intended to pierce a first wall of each capsule 7, 8, 9 when the lid 15 is in the closed position. On the other hand, the piercing means comprise hollow needles 14 connected in fluid communication to the water pump 2 of the mixing system and passing through the lid 15 respectively to pierce the second walls of the capsules 7, 8, 9 housed in the corresponding compartments 4, 5, 6.

The head of each hollow needle 14 includes a flared endpiece so that the needle 14 pierces a hole in the wall of the corresponding capsule 7, 8, 9 with a diameter larger than the diameter of the needle 14, which will make it possible to allow air to enter the capsule from the top when the capsule is emptied of its liquid, so as to make its flow easier. According to the same principle, the teeth 13 are wider at mid-height and at their base such that once the other wall of the corresponding capsule 7, 8, 9 is pierced, the holes are not plugged by the base of the teeth and the liquid can flow. The three capsules 7, 8, 9 will then be pierced simultaneously, but the liquids contained in the capsules 7, 8, 9 will flow successively, as will be seen later in the description.

The mixing device includes a container 11 positioned to be in fluid communication with the outlet 38*a*, 38*b*, 38*c* of each of the compartments 4, 5, 6 of the receptacle 3 and a mixing member 12 housed in the container 11 and able to create the cosmetic product in said container 11 from two mixtures respectively of water and cosmetic fat and of water and cosmetic active ingredient, and if applicable from a third mixture of water and cosmetic fragrance. These mixtures are obtained by circulation of water coming from the first water compartment 27 of the reservoir 1 through hollow needles 13 of the piercing means to pass through the capsules 7, 8, 9 housed in the respective compartments 4, 5, 6.

According to one preferred embodiment shown in the figures, the container 11 of the mixing device is a removable cylindrical tube closed by a bottom wall to allow the storage of the produced cosmetic product. The mixing member 12 in this embodiment comprises a piston 12*a* forming the bottom wall of the container 11 and a plurality of radial fins 22 secured to the piston 12*a* and protruding from the upper face of the piston 12*a*. The piston 12*a* is able to be rotated with the fins 22, when the removable container 11 is mounted on the mixing system, by a toothed crown 23 mounted in a support base 25 of the container 11 coaxially to the latter. The axial teeth 24*a* of the crown 23 are all situated on a same side of the crown 23 and are able to be coupled to the piston 12*a*. Furthermore, the toothed crown 23 comprises an axle portion 24*b* protruding perpendicular to the crown 23 and also intended to be coupled by clipping to the piston 12*a* to facilitate the centering of the piston 12*a* on the toothed crown 23 and to prevent any translational movement of the piston 12*a* in the container 11 when the piston 12*a* is rotated. The crown 23 can in turn be rotated by an electric motor of the mixing system controlled by the control means of the mixing system.

Furthermore, the bottom of the container 11 includes notches 11*a* to be embedded in corresponding stops on the base 25, which prevents the container 11 from rotating during the rotation of the piston 12*a* so that only the latter rotates. Lastly, the shape and the position of the fins 22 of the piston 12*a* preferably make it possible to produce an emulsion from the oil phase coming from the fat capsule 7 and from the water contained in the corresponding water compartment 27. In the remainder of the description, reference will preferably made to an emulsion, but any other type of cosmetic product that is simpler to produce, for example a gel or lotion, can be made with the mixing system.

The cosmetic fat contained in the corresponding capsule 7 is in the solid state. It is therefore necessary, in order to produce the mixture of water and cosmetic fat, to melt said fat and bring it to a temperature of around 75° C. A first alternative, not shown, consists of incorporating a heating resistance into the compartment 4 of the receptacle 3 of the cosmetic fat capsule 7. A second preferred alternative in particular shown in FIG. 1 is to incorporate heating means 10 for heating the water controlled by the control means of the mixing system and connected to the water pump 2 of the mixing system and the hollow needle 14 connected to the compartment 4 suitable for receiving the cosmetic fat capsule 7 and intended to transport said capsule 7. This heating means 10 may comprise an internal electrical resistance heating block. The two alternatives can be combined.

In this way, the water circulating toward the compartment 4 comprising the cosmetic fat capsule 7 and passing through the latter is hot and causes the cosmetic fat to melt, to allow the flow of the mixture in the container 11.

In a first alternative embodiment of the cosmetic product, the circulation of water is done simultaneously in all of the capsules 7, 8, 9, causing the simultaneous flow into the container 11 of the three mixtures, which are emulsified to form the cosmetic product. Nevertheless, in order to avoid exposing the cosmetic active ingredient, and if applicable a cosmetic fragrance, to excessively high temperatures, a second alternative embodiment of the cosmetic product described below is preferred.

Indeed, it is preferable first to produce, in the container 11, an emulsion of hot water and cosmetic fat, then to cool said emulsion. To that end, the mixing system comprises a hollow block for cooling water circulation 17 partially surrounding the container 11. The water inlet and outlet of said block 17 are connected to the second water compartment 28 of the reservoir 1 by another pump 18 to provide the cooling of the emulsion in the container 11. The quantity of emulsion to be cooled being negligible compared to the quantity of water in the compartment 28, the circulation of the cooling water in a closed loop is sufficient without risking this water heating up too much. At the end of this cooling, the active ingredient and the cosmetic fragrance are added to the emulsion to form the cosmetic product, by piercing of the capsules 8, 9 and potentially the circulation of water at ambient temperature coming from the first water compartment 27 of the reservoir 1 through the corresponding capsules 8, 9.

In order to provide the successive flow of the mixtures in the container 11, the mixing system comprises a rotary selector plate 16 controlled by the control means of the mixing system. This selector plate 16 is positioned between the respective outlets of the compartments 4, 5, 6 of the receptacle 3 and the container 11 and includes a through orifice 39 able to be positioned selectively and successively at the outlet 38*a* of the cosmetic fat capsule 7 compartment 4 for the passage of the water and cosmetic fat mixture in the container 11 and at the outlet 38*b* of the cosmetic active ingredient 8 compartment 5 for the passage of the mixture of water and cosmetic active ingredient in the container 11 and, if applicable, at the outlet 38*c* of the cosmetic fragrance capsule 9 compartment 6 for the passage of the water and cosmetic fragrance mixture in the container 11. Furthermore, the base 25 is translatable to make it possible to move the opening of the container 11 further away from or closer to the outlet of the through orifice 39 of the selector plate 16.

The circumferential edge of the selector plate 16 is toothed and meshing with a pinion 32 able to be rotated by an electric motor 33 secured to the housing of the mixing system and controlled by the control means. The capsule receptacle 3 and rotary selector plate 16 assembly is removable with respect to the general shell of the mixing system, the motor 33 being secured to the general shell of the machine.

Furthermore, the mixing system comprises two solenoid valves 19, 20 controlled by the control means and respectively positioned between the outlet of the water pump 2 of the mixing system and the heating means 10 of the water and between the outlet of the water pump 2 of the mixing system and the two compartments 5, 6 able respectively to receive the cosmetic active ingredient capsule 8 and the fragrance capsule 9. To make the connections possible, the inlets of the two solenoid valves 19, 20 are connected to the outlet of the water pump 2 of the mixing system via a T-connector 30, and the two compartments 5, 6 for active ingredient and fragrance capsules 8, 9 are connected to the outlet of the corresponding solenoid valve 20 by another T-connector 31.

All of the connections are done via flexible channels 29, for example made from polyvinyl chloride.

The mixing system also comprises a flowmeter 21 connected between the inlet of the water pump 2 of the mixing system and the outlet of the first water compartment 27 of the reservoir 1. As will be seen hereinafter, the data from the flowmeter 21 are used by the control means to deliver the necessary and sufficient volume of water through each capsule 7, 8, 9 to produce the cosmetic product.

A method for producing a cosmetic product using a mixing system according to the disclosure will now be described.

First, the user places the various capsules 7, 8, 9 in the compartments 4, 5, 6 of the receptacle 3, which for this step is separated from the mixing system together with the rotary plate 16. At minimum, the user inserts a cosmetic fat capsule 7 and a cosmetic active ingredient capsule 8 into the corresponding compartments 4, 5 of the receptacle 3. Preferably, the user also inserts a cosmetic fragrance capsule 9 into the corresponding compartment 6 of the receptacle 3. Once the capsules are in place, the user inserts the removable assembly formed by the receptacle 3 and the selector plate 16 into the mixing system. Next, the user places the base 25 in the lower position, if it is not already there, and clips the piston 12*a* on the toothed crown 23, next he clips the container 11 above the piston 12*a*, the piston 12*a* then being inside the container 11. He can then mount the base 25 in the upper position, the top of the bottle then being just below the opening of the through orifice 39 of the rotary selector plate 16.

Subsequently, the user lowers the lid 15 of the container 3 via the maneuvering arm 34 provided to that end, such that the lid 15 completely covers the compartments 4, 5, 6 of the receptacle 3 in which the capsules 7, 8, 9 are housed. In this way, the various capsules 7, 8, 9 present in the receptacle 3 are pierced, via the piercing means 13, 14, respectively at their first and second walls as previously described. The rotary selector plate 16 is at that moment in the closed position with respect to all of the compartments 4, 5, 6 of the receptacle 3, i.e., the through orifice 39 is not in fluid communication with any of the outlets 38*a*, 38*b*, 38*c* of the respective compartments 4, 5, 6.

Lastly, the user powers on the mixing system and initiates, for example by pressing on a button provided to that end, a program for producing cosmetic products stored in a memory space of the control means of the mixing system, said program being executed by the control means to allow the implementation of the method for producing the cosmetic product.

The first step of the method consists of supplying power to the electrical resistance of the heating block 10. Once the resistance 10 reaches an operating temperature, for example measured by a sensor comprised in the mixing system or simply after a determined length of time, the control means starts the water pump 2 connected to the first water compartment 27 of the reservoir 1 to initiate the circulation of water toward the compartment 4 of the receptacle 3 comprising the cosmetic fat capsule 7. The solenoid valve 19 connected to said compartment 4 is therefore opened by the control means such that a first volume of hot liquid calculated by the control means from data from the flowmeter 21 enters the oil capsule 7 to melt the fat. Once said volume of water has penetrated the capsule 7, the control means closes the solenoid valve 19. After a given length of time, the control means rotates the selector plate 16 such that the orifice 39 of said selector plate 16 is placed in fluid communication with the outlet 38*a* of said compartment 4 to allow the flow of the mixture of water and melted fat in the container. The motor controlling the rotation of the toothed crown 23 is set in rotation, causing the piston 12*a* and the fins 22 of the mixing member to be rotated in order to create an emulsion from the mixture of hot water and cosmetic fat flowing in the container 11. After the flow into the container 11 of said first volume of hot water mixed with the melted cosmetic fat, the control means opens the solenoid valve 19 to allow a second volume of water to flow through the capsule in order to rinse the remaining fat from the capsule 7.

After a given time, once the second volume of hot water calculated by the control means from the data from the flowmeter 21 has passed through the cosmetic fat capsule 7, the second step of the method is carried out.

During this second step, the solenoid valve 19 connected to the compartment 4 of the receptacle 3 comprising the cosmetic fat capsule 7 is closed, the resistance of the heating block 10 is no longer supplied with power and the water pump 2 connected to the first water compartment 27 of the reservoir 1 is stopped by the control means. Concomitantly, the water pump 18 connected to the second water compartment 28 of the reservoir 1 and the cooling water circulation block 17 is started up during a given time to cool the emulsion in the container 11.

Once the cooling time is elapsed and the emulsion has reached a temperature of about 40° C., the third step of the method is carried out: the control means optionally stops the water pump 18 connected to the cooling water circulation block 17 and commands the rotation of the selector plate 16 such that its orifice 39 is in fluid communication with the outlet 38*b* of the compartment 5 of the receptacle 3 in which the cosmetic active ingredient capsule 8 is housed. The capsule 8 is then emptied into the container 11. Next, the control means controls the rotation of the selector plate 16 such that its orifice 39 is in fluid communication with the outlet 38*c* of the compartment 6 of the receptacle 3 in which the cosmetic fragrance capsule 9 is housed, and the latter is emptied into the container 11. Then, the control means activates the water pump 2 connected to the first water compartment 27 of the reservoir 1, opens the solenoid valve 20 connected to the compartments 5 and 6 of the receptacle 3 comprising the cosmetic active ingredient capsule 8 and the perfume capsule 9. Rinse water is introduced into the capsules 8 and 9, the contents of the capsule 9 being emptied directly into the container 11. Once a third volume of water calculated by the control means from data from the flowmeter 21 has been delivered into the capsules 8 and 9, the control means closes the solenoid valve 20, stops the pump 18 and then commands the rotation of the selector plate 16 such that the orifice 39 returns to fluid communication with the orifice 38*b* of the compartment 5 comprising the active ingredient capsule 8, which is then emptied into the container 11. The electric motor that rotates the piston 12*a* and the fins 22 of the mixing member 12 remains supplied, allowing the incorporation into the emulsion of the mixture of water and cosmetic active ingredient as well as the mixture of water and fragrance.

Alternatively, if no fragrance capsule 9 is added into the corresponding compartment 6, the third step of the method nevertheless takes place in the same way. The water passing through the solenoid valve 20 will simply pass through the empty compartment 6 toward the container 11.

During the fifth step of the method, the control means powers on the motor intended to drive the toothed crown 23, which stops the piston 12*a* and the fins 22 of the mixing member 12, when the cosmetic product reaches a temperature below 35° C., or even 30° C., or after a determined length of time. The user can then recover the container 11 with the piston 12*a*, which serves as bottom wall. A cover can be placed on the opening of the container 11 to shelter the cosmetic product from air and preserve it. More specifically, the user lowers the base 25, clips the lid on the container 11 and unclips the container 11 from the toothed crown 23. He can next raise the lever 34 and remove the removable assembly formed by the receptacle 3 and the selector plate 16 to dispose of the used capsules and rinse the removable assembly.

Advantageously, the user can use the container 11 removed from the mixing system and filled with the cosmetic product produced using the mixing system as bottle for storing and dispensing the cosmetic product. To that end, a head closes the opening of the container 11 opposite the piston 12*a*, this head including a dispensing pump for the cosmetic product provided with a trigger able to be actuated manually. Furthermore, the head comprises a rigid tube submerged in the cosmetic product. Said head with dispensing pump and trigger is well known by one skilled in the art, and is for example found on certain cosmetic cream bottles. Thus, when the user presses on the trigger, a volume of cosmetic product is dispensed at the outlet of the head. When the user releases the trigger, a vacuum in the container 11 is created, which causes the piston 12*a* to move in the container 11 toward the head, to offset the dispensed volume of cosmetic product. The free end of the rigid tube secured to the head will therefore always be submerged in the cosmetic product.

The configuration of the mixing system of the disclosure is not limited to the embodiment previously described and shown in the figures. It has been provided solely as a non-limiting example. Other changes can be made without going beyond the scope of the disclosure. In particular, the container 11 of the mixing device may not be removable, and the mixing member 12 then comprises a helix mounted at the bottom of the container 11 on an axle coaxial to the latter. This axle is mounted in the bottom wall of the container 11 and can be driven by an electric motor mounted in the mixing system and controlled by the control means of the mixing system. Furthermore, in order to recover the cosmetic product made in a storage bottle, the container 11 comprises a timed valve in its bottom wall to allow the flow of the emulsion by gravity. Alternatively, this valve is able to be actuated manually, and the cosmetic product flows by gravity in the bottle if it is relatively fluid, or by overpressure applied in the container 11 by an appropriate hydraulic or pneumatic system if the product is too thick or viscous. It is also possible to imagine, in place of the selector plate 16, the pinion 32 and the associated motor 33, a set of solenoid valves whose inlets are placed in fluid communication respectively with the outlets 38*a*, 38*b*, 38*c* of the respective compartments 4, 5, 6 of the receptacle 3. Lastly, it is possible to imagine a cooling block 28 with no water circulation, said block 28, comprising a cold accumulator liquid, being placed in the freezer before use of the mixing system. In this case, the liquid reservoir 1 has a single compartment and the second water pump 18 is not necessary.

The invention claimed is:

1. A mixing system for manufacturing a cosmetic product comprising:

a liquid reservoir;

a liquid pump connected to the outlet of the liquid reservoir;

a receptacle comprising two compartments connected to the liquid pump and suitable for respectively including two capsules containing, for one, a cosmetic texturizing agent, and the other, a cosmetic active ingredient and means for piercing the capsules to allow a forced circulation of liquid from the liquid pump through the two capsules;

a heating means for the liquid having passed through the cosmetic texturizing agent capsule; and a mixing device comprising a container positioned to be in fluid communication with the outlet of each of the two compartments of the receptacle and a mixing member housed in the container and able to create, in said container, the cosmetic product from the two mixtures of liquid and cosmetic texturizing agent and of liquid and cosmetic active ingredient coming from two compartments of the receptacle to produce the cosmetic product;

wherein the receptacle comprises teeth protruding from the bottom wall of each compartment to respectively pierce first walls of the capsules placed in the corresponding compartments, and hollow needles connected to the liquid pump and passing through a manually movable cover of the receptacle and intended to cover the compartments to respectively pierce second walls of the capsules placed in the corresponding compartments.

2. The mixing system according to claim 1, wherein the mixing member is a helix mounted at the bottom of the container on an axle coaxial thereto, passing through the bottom wall of the container and able to be driven by a motor mounted in the mixing system.

3. The mixing system according to claim 1, wherein the container comprises an opening with a timed valve in its bottom wall to allow the flow of the hot cosmetic product into a storage bottle for the cosmetic product.

4. The mixing system according to claim 1, wherein the container is a removable cylindrical tube closed by a bottom wall to allow the storage of the cosmetic product for later use thereof and positioned below two compartments of the receptacle.

5. The mixing system according to claim 1, wherein the receptacle includes a third compartment connected to the liquid pump and suitable for including a third capsule containing a cosmetic fragrance intended to be included in the composition of the cosmetic product, the container also being connected at the outlet of said third compartment.

6. The mixing system according to claim 1, further comprising a hollow coolant circulation block at least partially surrounding the container, and whereof the liquid inlet and outlet of said coolant block are connected to the liquid reservoir by another pump to provide the cooling of the mixture contained in the container.

7. The mixing system according to claim 6, wherein the liquid reservoir comprises two compartments separated by an inner wall, one of the compartments being connected to the liquid pump of the mixing system and the other compartment being connected to the cooling block via the other pump.

8. The mixing system according to claim 1, wherein the heating means is an internal electrical resistance heating block positioned between the liquid pump of the mixing system and the compartment suitable for receiving the cosmetic texturizing agent capsule.

9. The mixing system according to claim 1, further comprising two solenoid valves respectively positioned between the liquid pump of the mixing system and the compartment capable of receiving the cosmetic texturizing agent capsule and between the liquid pump of the mixing system and at least the other compartment capable of receiving the cosmetic active ingredient capsule, to control the circulation of liquid in the compartments through the capsules.

10. The mixing system according to claim 9, further comprising:

a controlled rotary selector plate positioned between the respective outlets of the compartments and the container and including a through orifice able to be positioned selectively and successively at the outlet of the cosmetic texturizing agent capsule compartment for the passage of the mixture of liquid and cosmetic texturizing agent in the container and at the outlet of the cosmetic active ingredient capsule compartment for the passage of the mixture of liquid and cosmetic active ingredient in the container; and a flow meter connected to the liquid pump of the mixing system and in that it comprises a control means successively able to:

move the selector plate to bring its orifice into fluid communication with the outlet of the compartment including the cosmetic texturizing agent capsule and open the solenoid valve connected to said compartment to provide the circulation during a given time interval of a first liquid volume through the capsule and calculated from data from the flowmeter;

move the selector plate to bring its orifice into fluid communication with the outlet of the compartment including the cosmetic active ingredient capsule, open the solenoid valve connected to said compartment to provide the circulation during a given time interval of a second volume of liquid through the capsule and calculated from data from the flowmeter, and close the solenoid valve connected to the compartment comprising the cosmetic texturizing agent capsule;

move the selector plate to bring its orifice into fluid communication with the outlet of the compartment including the cosmetic fragrance capsule and keep the solenoid valve connected to said compartment and to the compartment including the cosmetic active ingredient capsule open in order to provide the circulation, during a given time interval, of a third volume of liquid through the cosmetic fragrance capsule and calculated from data from the flowmeter.

11. The mixing system according to claim 1, wherein the mixing member of the mixing device makes it possible to produce an emulsion from two mixtures of liquid coming from the reservoir and melted cosmetic texturizing agent and liquid coming from the reservoir and cosmetic active ingredient coming from the two compartments of the receptacle, from the third liquid mixture coming from the reservoir and cosmetic fragrance coming from the third compartment of the receptacle to produce the cosmetic product.

12. The mixing system according to claim 1 configured with two capsules respectively comprising a cosmetic texturizing agent and a cosmetic active ingredient for producing a cosmetic product.

13. The mixing system according to claim 12 with a third capsule containing a cosmetic fragrance.

14. A mixing system for manufacturing a cosmetic product comprising:

a liquid reservoir;

a liquid pump connected to the outlet of the liquid reservoir;

a receptacle comprising two compartments connected to the liquid pump and suitable for respectively including two capsules containing, for one, a cosmetic texturizing agent, and the other, a cosmetic active ingredient and means for piercing the capsules to allow a forced circulation of liquid from the liquid pump through the two capsules;

a heating means for the liquid having passed through the cosmetic texturizing agent capsule;

a mixing device comprising a container positioned to be in fluid communication with the outlet of each of the two compartments of the receptacle and a mixing member housed in the container and able to create, in said container, the cosmetic product from the two mixtures of liquid and cosmetic texturizing agent and of liquid and cosmetic active ingredient coming from two compartments of the receptacle to produce the cosmetic product; and a controlled rotary selector plate positioned between the respective outlets of the compartments and the container and including a through orifice able to be positioned selectively and successively at the outlet of the cosmetic texturizing agent capsule compartment for the passage of the mixture of liquid and cosmetic texturizing agent in the container and at the outlet of the cosmetic active ingredient capsule compartment for the passage of the mixture of liquid and cosmetic active ingredient in the container.

15. A mixing system for manufacturing a cosmetic product comprising:

a liquid reservoir;

a liquid pump connected to the outlet of the liquid reservoir;

a receptacle comprising two compartments connected to the liquid pump and suitable for respectively including two capsules containing, for one, a cosmetic texturizing agent, and the other, a cosmetic active ingredient and means for piercing the capsules to allow a forced circulation of liquid from the liquid pump through the two capsules;

a heating means for the liquid having passed through the cosmetic texturizing agent capsule;

a mixing device comprising a container positioned to be in fluid communication with the outlet of each of the two compartments of the receptacle and a mixing member housed in the container and able to create, in said container, the cosmetic product from the two mixtures of liquid and cosmetic texturizing agent and of liquid and cosmetic active ingredient coming from two compartments of the receptacle to produce the cosmetic product;

wherein the container is a removable cylindrical tube closed by a bottom wall to allow the storage of the cosmetic product for later use thereof and positioned below two compartments of the receptacle; and wherein the mixing member comprises a piston forming the bottom wall of the container and a plurality of radial fins secured to the piston and protruding from the upper face of the piston that is able to be rotated with the fins, when the removable container is mounted on the mixing system, by a toothed crown mounted in a support base of the container coaxially to the latter and the axial teeth of which situated on a same side are coupled to the piston, said toothed crown being able to be rotated by an electric motor of the mixing system.

16. A mixing system according to claim 15, comprising the container filled with a cosmetic product and a head closing the opening of the container opposite the piston and including a pump for dispensing the cosmetic product and a trigger able to be actuated manually for dispensing a volume of cosmetic product at the outlet of the head during pressing on the trigger and to create a vacuum in the container causing the piston to move in the container toward the head in order to offset the volume of cosmetic product dispensed.

* * * * *